US011530067B1

(12) United States Patent
Crum et al.

(10) Patent No.: US 11,530,067 B1
(45) Date of Patent: Dec. 20, 2022

(54) LABELING SYSTEMS AND METHODS OF MAKING AND USING SAME

(71) Applicant: WARD KRAFT, INC., Fort Scott, KS (US)

(72) Inventors: Jesse Crum, Fort Scott, KS (US); Young Min Yoo, Fort Scott, KS (US); Randy Zimmerman, Fort Scott, KS (US); Doug Defebaugh, Fort Scott, KS (US); Roger Kraft, Fort Scott, KS (US)

(73) Assignee: Ward-Kraft, Inc., Fort Scott, KS (US)

( * ) Notice: Subject to any disclaimer, the term of this patent is extended or adjusted under 35 U.S.C. 154(b) by 72 days.

(21) Appl. No.: 16/593,358

(22) Filed: Oct. 4, 2019

Related U.S. Application Data

(63) Continuation-in-part of application No. 16/144,583, filed on Sep. 27, 2018, now Pat. No. 10,726,746.
(Continued)

(51) Int. Cl.
*B65C 9/46* (2006.01)
*B65C 9/00* (2006.01)
(Continued)

(52) U.S. Cl.
CPC ..... *B65C 9/46* (2013.01); *B65C 9/0015* (2013.01); *B65C 9/02* (2013.01); *B65C 9/26* (2013.01); *B65C 2009/0018* (2013.01)

(58) Field of Classification Search
CPC ..... B65C 9/0015; B65C 9/02; B65C 9/22; B65C 9/2204; B65C 9/2208;
(Continued)

(56) References Cited

U.S. PATENT DOCUMENTS 2,178,979 A * 11/1939 Von Hofe ..... B65C 9/2221 156/314
3,574,153 A 4/1971 Julius
(Continued)

FOREIGN PATENT DOCUMENTS

WO WO-2011085790 A2 * 7/2011 ..... B31D 1/021
WO WO-2018081922 A1 * 5/2018 ..... B65C 9/26

OTHER PUBLICATIONS

Translation of WO-2011085790-A2, Rothen J, Jul. 2011 (Year: 2011).*

(Continued)

*Primary Examiner* — George R Koch
(74) *Attorney, Agent, or Firm* — Avek IP, LLC

(57) ABSTRACT

A method for printing and applying labels comprises printing indicia on a first label using a printer to form a first printed label and holding the first printed label in a holding tray. The method includes moving an arm from an original position to a first position to collect the first printed label from the holding tray, and rotating the arm in a first direction to move the first printed label towards a substrate. The method comprises moistening the first printed label to activate a dissolvable liner of the first printed label. The method includes using the arm to apply the moistened first printed label to the substrate. The arm is rotated in a second direction away from the substrate. The printer prints a second label before the arm returns to the original position to collect the second label from the holding tray.

18 Claims, 13 Drawing Sheets

Related U.S. Application Data

(60) Provisional application No. 62/741,511, filed on Oct. 4, 2018.

(51) Int. Cl.
*B65C 9/26* (2006.01)
*B65C 9/02* (2006.01)

(58) Field of Classification Search
CPC ..... B65C 9/2213; B65C 9/2226; B65C 9/223; B65C 9/2234; B65C 9/26; B65C 9/40; B65C 9/46; B65C 2009/0018
See application file for complete search history.

(56) References Cited

U.S. PATENT DOCUMENTS

| | | | | |
|---|---|---|---|---|
| 4,575,525 | A | 3/1986 | Wacome et al. | |
| 4,623,688 | A | 11/1986 | Flanagan | |
| 5,296,535 | A | 3/1994 | Nesiewicz et al. | |
| 5,931,098 | A * | 8/1999 | Bates | B41J 25/308 101/43 |
| 5,977,021 | A | 11/1999 | Aoyama et al. | |
| 6,080,250 | A * | 6/2000 | Urban | B65C 1/021 156/64 |
| 6,589,623 | B2 | 7/2003 | Roth | |
| 6,616,189 | B2 | 9/2003 | Raming | |
| 8,109,537 | B2 | 2/2012 | Raming | |
| 8,129,010 | B2 | 3/2012 | Kobayashi et al. | |
| 9,418,576 | B2 | 8/2016 | Franklin | |
| 2003/0012910 | A1 | 1/2003 | Galovie | |
| 2006/0216537 | A1 | 9/2006 | Natsui et al. | |
| 2008/0030019 | A1 | 2/2008 | Hofer et al. | |
| 2009/0252905 | A1 | 10/2009 | Hill et al. | |
| 2010/0156087 | A1 | 6/2010 | Raming | |
| 2010/0259037 | A1 | 10/2010 | Hanrahan et al. | |
| 2011/0033698 | A1 * | 2/2011 | Woods | B65C 9/2213 428/346 |
| 2011/0061802 | A1 | 3/2011 | Raming | |
| 2019/0047738 | A1 * | 2/2019 | Nishimura | B65C 9/02 |
| 2020/0071015 | A1 * | 3/2020 | Fan | B65C 9/26 |

OTHER PUBLICATIONS

Notice of Allowance, dated Apr. 1, 2020, 14 pages, issued in U.S. Appl. No. 16/144,583.
Final Office Action, dated Mar. 22, 2022, 26 pages, issued in U.S. Appl. No. 16/593,358.
Non-Final Office Action, dated Apr. 1, 2022, 6 pages, issued in U.S. Appl. No. 17/068,706.

* cited by examiner

LABELING SYSTEMS AND METHODS OF MAKING AND USING SAME

CROSS-REFERENCE TO RELATED APPLICATIONS

This application is a continuation-in-part of U.S. patent application Ser. No. 16/144,583, filed Sep. 27, 2018, now U.S. Pat. No. 10,726,746 B1. This application also claims priority to U.S. Provisional Patent Application Ser. No. 62/741,511, filed Oct. 4, 2018. The disclosure of each is incorporated herein by reference in its entirety.

FIELD OF THE DISCLOSURE

The disclosure relates generally to the field of printing and applying labels. More specifically, the disclosure relates to the field of automated and semi-automated labeling systems.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

According to an embodiment, a method for printing and applying labels comprises printing indicia on a first label using a printer to form a first printed label and holding the first printed label in a holding tray. The method includes moving an arm from an original position to a first position to collect the first printed label from the holding tray, and rotating the arm in a first direction to move the first printed label towards a substrate. The method comprises moistening the first printed label to activate a dissolvable liner of the first printed label. The method includes using the arm to apply the moistened first printed label to the substrate. The arm is rotated in a second direction away from the substrate. The printer prints a second label before the arm returns to the original position to collect the second label from the holding tray.

According to another embodiment, method for printing and applying labels comprises printing indicia on a first label using a printer to form a first printed label and holding the first printed label in a holding tray. The method includes moving an arm from an original position to a first position to collect the first printed label from the holding tray, and rotating the arm in a first direction to move the first printed label towards a substrate. The method comprises moistening the first printed label to activate a dissolvable liner of the first printed label. The method includes using the arm to apply the moistened first printed label to the substrate. The arm is rotated in a second direction away from the substrate.

According to yet another embodiment, a method for printing and applying labels comprises printing indicia on a first label using a printer to form a first printed label and holding the first printed label in a holding tray. The method includes moving an arm from an original position to a first position to collect the first printed label from the holding tray, and rotating the arm in a first direction to move the first printed label towards a substrate. The method includes using the arm to apply the first printed label to the substrate. The arm is rotated in a second direction away from the substrate. The printer prints a second label before the arm returns to the original position to collect the second label from the holding tray.

BRIEF DESCRIPTION OF THE SEVERAL VIEWS OF THE DRAWINGS

Illustrative embodiments of the present disclosure are described in detail below with reference to the attached drawing figures.

DETAILED DESCRIPTION

Figure 1:
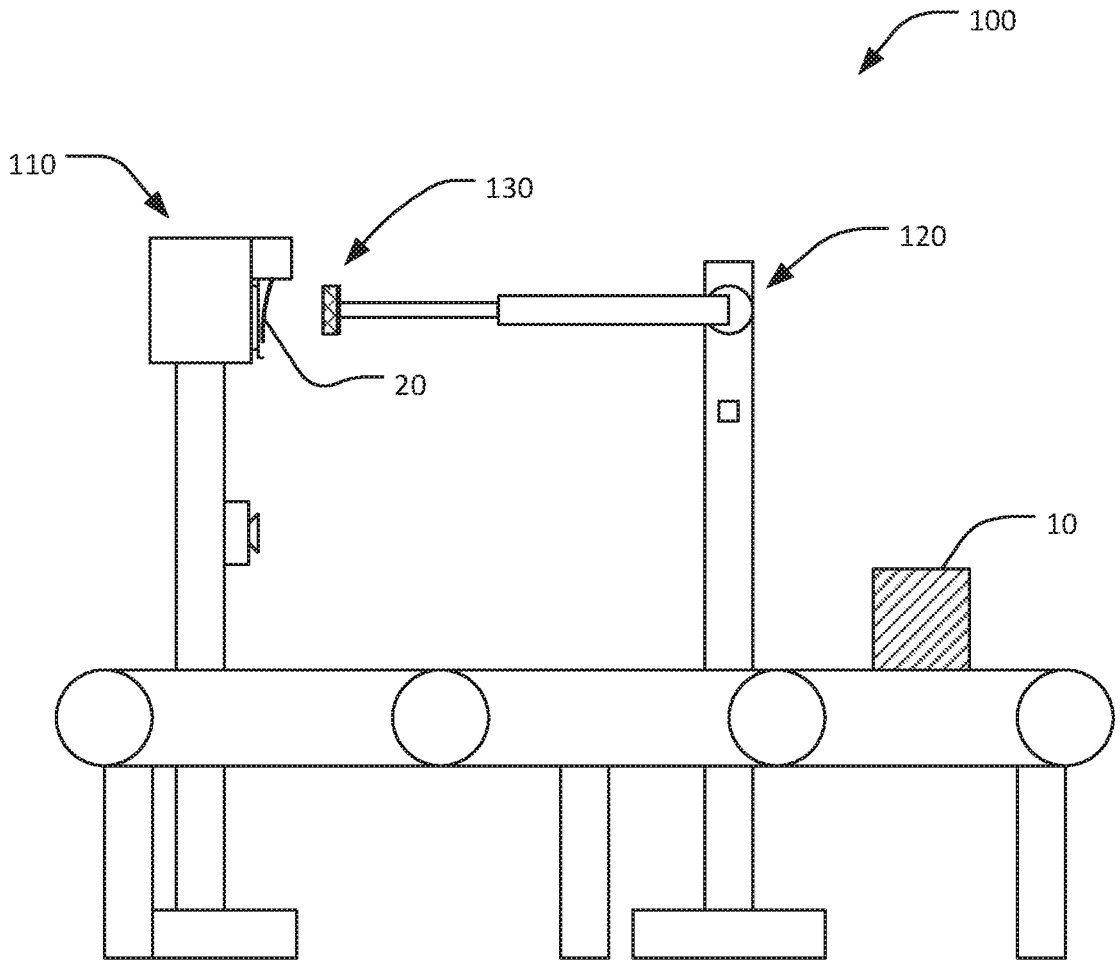
FIG. 1 is a side view of a label printing and applying system, according to an embodiment of the present disclosure.

Label applicators for applying labels (e.g., shipping labels, return labels, product labels, etc.) to substrates are known in the art. A traditional label applicator apparatus comprises a printer for printing indicia on the label and a tamp head which in its original position is situated upwardly adjacent the printed label. The tamp head working surface extends generally horizontally and may have vacuum nozzles or other means for holding the label to the tamp head during the application process. The printer prints indicia on the label and the label is pushed laterally underneath the tamp head. The tamp head remains stationary until the printing of the label is complete and the label is brought in registry with the tamp head above the label. Once the label printing is complete and the entire label is below and in registry with the tamp head, the tamp head moves vertically downward towards a substrate and, due to the vacuum, causes the printed label to travel with the tamp head. The tamp head eventually sandwiches the printed label between itself and the substrate (e.g., the package to which the label is to be adhered, which may be brought underneath the tamp head via a conveyer belt for instance). The adhesive on the underside of the label (e.g., on the face stock thereof) causes the label to adhere to the substrate. The tamp head then moves vertically back up to its original position, and the next label is subsequently printed and situated underneath the tamp head so that the tamp head can apply the next label to the next substrate (e.g., another box on the moving conveyer belt). This process is repeated for each label that is printed and applied to a substrate.

One issue with the traditional label applicator is that the next label cannot be prepared for application (e.g., printed) until the tamp head returns to its original position after applying the preceding label. This is because if the next label were to be printed (and all or part thereof were to exit the printer), the tamp head would not be able to move vertically upwards to its original position without interacting with the next label. Such interaction between the tamp head and the fully or partially printed label may be problematic because the label may undesirably stick to the tamp head as the tamp head moves upward from its lowermost position (upon applying the label) toward its original position. To preclude such contact, the printer of the prior art labeling apparatus typically waits to print the next label until after the tamp head has applied the preceding label to the substrate and has returned to its original position thereafter. Once the preceding label has been applied and the tamp head has returned to its original position, the printer then prints the next label. As before, the next label is brought into registry with the tamp head, and once the printing is complete, the tamp head moves downward and sandwiches the next label between the tamp head and the next substrate to cause the next label to adhere to the next substrate.

It may be inefficient to have to wait to start printing the next label until after the tamp head has returned to its original position after applying the preceding label to a substrate (which may be referred to herein, as a "wait time" or a "waiting time requirement"). The wait time is downtime which may reduce the number of labels that may be printed and applied to substrates in a period of time (e.g., every minute). Such downtime may be particularly undesirable because the process of printing and applying labels to substrates may be repeated a multitude (e.g., many thousands) of times every day. Elimination of this waiting time requirement may allow for additional labels to be printed and applied in a time period (e.g., each minute), and consequently, improve the efficiencies of the label printing and application process and reduce the costs associated therewith. Embodiments of the present disclosure may relate to a label making and applying apparatus that eliminates the waiting time requirement.

FIGS. 1 through 4 show a label making and applying system embodiment 100 (also referred to herein as the "labeling apparatus"). The labeling apparatus 100 may be used to print labels 20, and may, in embodiments, include a staging area 110, an automated or semi-automated arm 120, and a tamp head 130. The labeling apparatus 100 may also have associated therewith means (e.g., a conveyer belt) to allow for one or more substrates (e.g., a cardboard or other box, a surface, a ply, clothing, packaging, etc.) to be successively placed at a location where a label (e.g., a label 20) may be adhered thereto by the apparatus 100. In embodiments, the labeling apparatus 100 may make use of a computing system 160 (FIG. 11) to perform the functions described herein.

Figure 2:
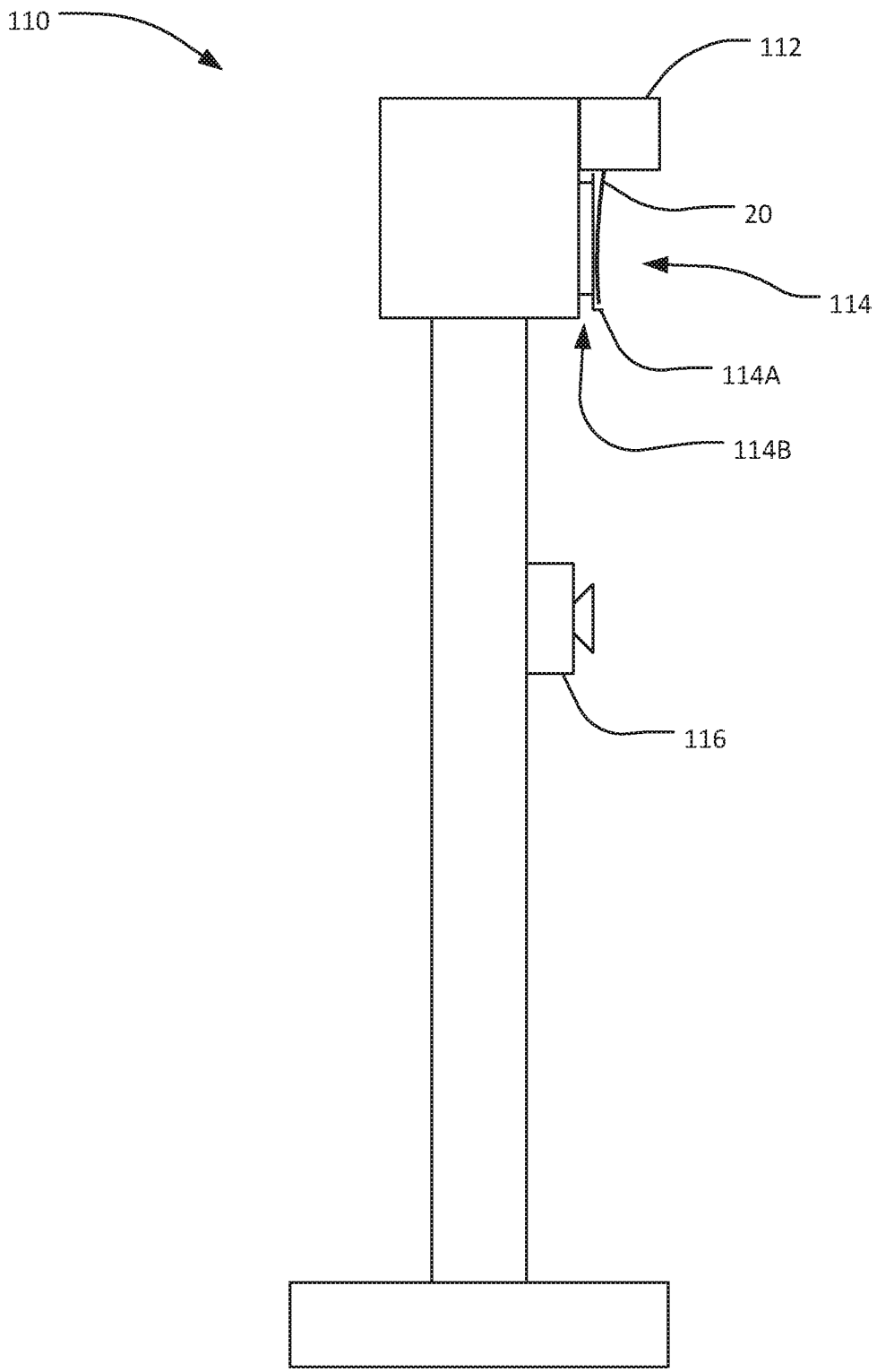
FIG. 2 is a side view of a staging area of the label printing and applying system of FIG. 1.

As seen in FIG. 2, the staging area 110 may in embodiments comprise a printer 112 and a holding tray 114. The printer 112 may be any printer now known or subsequently developed (e.g., a laser printer, an inkjet printer, a direct thermal printer, a thermal transfer printer, a commercial printer, a handheld printer, etc.) for suitably printing the label 20, and may be configured to print indicia (e.g., personalized and/or generic indicia, color and/or black and white indicia, etc.) thereon. The holding tray 114 may be configured to hold labels, e.g., a label 20, during the printing process and/or after the label 20 has been printed by the printer 112 (e.g., until the tamp head 130 returns to its original position after applying the preceding label, as discussed herein). The printer 112 may print relevant indicia (e.g., packaging information, shipping information, marketing materials, etc.) on the label 20, and deposit the label 20 in the holding tray 114. In an embodiment, the printer 112 may begin the printing of an additional label 20 as soon as the preceding label 20 is removed from the holding tray 114. In another embodiment, the printer 112 may begin printing the next label 20 within 1, 2, 3, or 4 seconds of the removal of the preceding label 20 from the tray 114.

The holding tray 114 may be a receptacle (e.g., a plate, bin, tub, tray, etc.) configured to receive and hold the labels 20 processed by the printer 112 for the tamp head 130. The holding tray 114 may, in embodiments, extend generally vertically. In embodiments, the holding tray 114 may have a lip or one or more protruding edges 114A (which may extend generally laterally or otherwise be perpendicular to the vertically extending portion of the holding tray 114) to aid in holding the label 20 within the holding tray 114 after the label 20 has been printed by the printer 112. In other embodiments, the holding tray 114 may have a textured plasma or other coating configured to inhibit the labels 20 from undesirably adhering to the holding tray 114.

Alternately or additionally to the lip 114A, the holding tray 114 may, in embodiments, be charged with a vacuum to hold the label 20 within it. For example, the holding tray 114 may include a vacuum plate 114B configured to selectively retain the label 20 with an applied vacuum. The vacuum plate 114B may, for example, apply the vacuum constantly, intermittently (e.g., at timed intervals that are in synchronization with a printing cycle of the printer 112), manually, and/or automatically. The vacuum plate 114B may automatically apply the vacuum in response to, for example, a sensor (e.g., a sensor 128) detection of the printed label 20. As another example, the vacuum plate 114B may automatically apply the vacuum in response to a signal from the printer 112 indicating that that the printing of the label 20 is (or is about) complete and the label will be deposited within the holding tray 114.

To allow the label 20 to be collected by the automated arm 120, the vacuum plate 114B may cease operation and release the label 20 from the vacuum plate 114B vacuum. Similar to the methods of applying the vacuum described above, the label 20 may be released from the vacuum plate 114B intermittently (e.g., at timed intervals that are in synchronization with a collection cycle of the automated arm 120), manually, and/or automatically. The vacuum plate 114B may automatically release the label 20 in response to, for example, a sensor (e.g., a sensor 128) detection that the automated arm 120 is ready, or is about ready, to collect the label 20. As another example, the vacuum plate 114B may automatically release the label in response to a signal from the automated arm 120 indicating that the automated arm is prepared to collect the label 20. In some embodiments, the vacuum plate 114B may apply a vacuum charge that is configured to be overpowered or otherwise replaced by another vacuum charge (e.g., by a vacuum charge of the tamp head 130, as will be discussed in greater detail below). That is to say, the vacuum plate 114B vacuum may be overridden by a vacuum from another source, and thus the other source may collect the label 20 form the holding tray 114.

In embodiments, the label 20, e.g., on an underside thereof, may include a "dissolvable liner." The dissolvable liner of the label 20 is unlike traditional paper liners that have to be peeled away from the face stock of the label 20 to expose the adhesive on the underside of the face stock.

While traditional labels having conventional adhesive (e.g., pressure sensitive adhesive) may undesirably adhere to the holding tray 114 if they were held therein without the traditional paper liners, the dissolvable liner may circumvent such issues. In other words, the dissolvable liner may allow the labels 20 to be held in the holding tray 114 without allowing for undue interaction (e.g., adhesion) between the face stock of the label 20 and the holding tray 114.

Broadly, the phrase "dissolvable liner", as used herein, refers to a cover or coating for covering a first composition, which cover is specifically adapted to begin to dissolve or otherwise dispel when the cover is brought into contact with a second composition. When the cover is brought into contact with a third composition (either after the cover is brought into contact with the second composition or generally simultaneously therewith), the cover is configured to be absorbed into both the first composition and the third composition. In embodiments, the first composition may be an adhesive arranged on the label 20, the second composition may be water (e.g., water vapor, liquid water, et cetera), and the third composition may be the substrate 10. That is, in embodiments, the dissolvable liner may be a composition that: (a) covers the adhesive layer of the label 20 so as to preclude the adhesive layer from undesirably sticking to another object or surface (the dissolvable liner inert state); and (b) is configured to dissolve and/or dispel when the dissolvable liner is brought into contact with a fluid (the dissolvable liner activated state). In the activated state, the label 20 with the dissolvable liner may be readily adhered to the substrate 10 (i.e., the activated dissolvable liner may disintegrate and expose the label 20 adhesive layer). The term "dissolvable liner", as used herein, specifically excludes a traditional liner ply or plies, such as paper coated at least in part with silicone or other release material, a film, et cetera. The term "dissolve", as used herein, connotes that the dissolvable liner coating, once wetted, is dispelled or otherwise displaced. The dissolvable liner may be absorbed (e.g., partially, wholly) by the substrate 10. The dissolvable liner may thus perform the same function of a traditional liner (i.e., to cover the adhesive layer until the label is ready to be secured to a substrate) made of paper or polyester, but without employing a traditional liner ply.

As illustrated in Table 1 below, in embodiments the dissolvable liner may include a remoistenable adhesive 222 (e.g., a non-toxic remoistenable adhesive), activated coconut carbon filtered water 224, and powdered gypsum 226. The activated coconut carbon filtered water 224—which, as is known, may be devoid of many of the impurities typically found in tap water—may desirably affect the viscosity of the remoistenable adhesive 222 for the instant application. Further, it is believed that the activated coconut carbon filtered water 224 may allow the final dissolvable liner composition to disintegrate and dissolve readily upon the application of tap or other water (as discussed below). The powdered gypsum 226 may serve, among other things, to increase the stability and the temperature resistance of the remoistenable adhesive 222. The gypsum 226 may also serve as a blocking agent, such as by precluding the remoistenable adhesive 222 from being undesirably activated in humid ambient conditions. In embodiments, the dissolvable liner may include different (e.g., additional) ingredients. For example, where it is desired to give the dissolvable liner a hue (e.g., an off-white (or any other) hue such that the dissolvable liner resembles the traditional paper liners), a colored pigment may be included to impart such a hue to the dissolvable liner.

Table 1 below shows the constituents of the dissolvable liner (also referred to herein as a "dissolvable liner coating"), according to one illustrative embodiment of the present disclosure, with which the label 20 may be coated to preclude the face ply from undesirably adhering to objects and to allow the label to be adhered to the substrate 10 when desired. The dissolvable liner may temporarily cover the label 20 back face while the label 20 printable faceis exposed for printing.

TABLE 1

DISSOLVABLE LINER 115

| No. | Ingredient 202 | Quantity range 204 | Preferred quantity 206 |
|---|---|---|---|
| 1 | Non-toxic remoistenable adhesive 222 | 2 lbs. to 6 lbs. | 4 lbs. |
| 2 | ACC water 224 | 0.125 lbs. to 0.375 lbs. | .25 lbs. |
| 3 | Gypsum 226 | 1-50 heaping teaspoons (about 0.05 lbs. to 2.8 lbs.) | 21 heaping teaspoons (about 1.2 lbs) |

The quantity ranges 204 and the preferred quantities 206 of the various ingredients 202 listed above are merely exemplary and are not intended to be independently limiting. For example, in embodiments, more activated coconut carbon filtered water 224 ("ACC water") may be added to reduce the viscosity of the dissolvable liner coating 115, more gypsum 226 may be added to further enhance the stability of the adhesive 222, et cetera. Further, in embodiments, the preferred quantities 206 of the various ingredients 202 listed above may be proportionally reduced or increased for smaller or larger applications, respectively. The preferred quantities 206 listed above will yield a volume of about 5.45 lbs. of the dissolvable liner coating 115, which may be used to coat many thousands of labels. A method 500 (FIG. 12) for making and using a label with a dissolvable liner is discussed in greater detail below.

In an embodiment, the remoistenable adhesive 222 may have a vapor pressure at 20° C. of about 23.4 hPa, a density at 20° C. of about 1.08 g/cm$^3$, a pH value at 20° C. of 4.0-6.0, a flash point of over 232° C., and a VOC content of 1.6 g/l/0.01 lb/gl. For example, in an embodiment, the remoistenable adhesive 222 may be the PriscoBond 121-H remoistenable adhesive commercially available by Prisco®. Alternately or additionally, in other embodiments, the remoistenable adhesive may be one or more of the remoistenable adhesives disclosed in U.S. Pat. No. 3,574,153 to Sirota, U.S. Pat. No. 4,575,525 to Wancome et al., U.S. Pat. No. 4,623,688 to Flanagan, U.S. Pat. No. 5,296,535 to Fazioli et al., each of which are incorporated by reference herein. Other remoistenable adhesives known to the artisan and/or subsequently developed may likewise be employed. Applicant's experimentation confirms that off-the-shelf remoistenable adhesives 222 disclosed herein, such as the PriscoBond 121-H product, cannot suitably be used as adhesive covers for labels until the other ingredients 202 (i.e., the ACC water 224 and Gypsum 226) are added thereto.

In embodiments, the dissolvable liner may exhibit adhesive properties only after the dissolvable liner is activated by a fluid. Such a dissolvable liner configuration may be referred to herein as a "dissolvable adhesive liner." Much like the dissolvable liner discussed above, the dissolvable adhesive liner may be selectively activatable (i.e., between an inert state and an activated state) by applying a fluid (e.g., water) thereto.

In a label employing the dissolvable adhesive liner, the adhesive layer traditionally employed in labels (including in the dissolvable liner label discussed above) may be replaced with a hydrophilic coating, and the traditional adhesive layer may be omitted in its entirety. The dissolvable adhesive liner may thus include a face stock that on its underside has a hydrophilic coating which is covered by a dissolvable liner. The hydrophilic coating may be any coating with suitable hydrophilic properties, such as an inkjet coating. The hydrophilic coating may be arranged between the dissolvable liner and a face ply of the label 20 such that the dissolvable liner covers the hydrophilic coating. Upon activation, the dispelled dissolvable liner of the dissolvable adhesive liner may be drawn (i.e., absorbed) into both the hydrophilic coating and the substrate 10. When so absorbed, the dissolvable adhesive liner may exhibit adhesive properties and form a bond with both the label 20 and the substrate 10, thus causing the label 20 to adhere to the substrate 10.

Thusly, a label 20 with such a dissolvable adhesive liner may forgo a traditional adhesive layer and a traditional liner ply. Because the label 20 with a dissolvable adhesive liner may not use a conventional adhesive layer, such a label may be printed using any technology now known or subsequently developed (such as a direct thermal printer, a thermal transfer printer, a laser printer, an inkjet printer, et cetera). The dissolvable adhesive liner may be heat-resistant and may be able to readily withstand the relatively high temperatures encountered by labels in printers (e.g., laser printers).

As discussed above, a label 20 having a dissolvable liner or a dissolvable adhesive liner may transition to the activated state (and thus be made ready for adherence to a surface) once said liner is brought into contact with a fluid. As such, the staging area 110 may, in embodiments, comprise a sprayer or other fluid dispensing means 116 downstream the printer 112, as shown in FIG. 2. In embodiments, the sprayer 116 may be downstream the holding tray 114. The sprayer 116 may be fluidly coupled to a tank for retaining fluid (e.g., water or other fluid for dispelling the dissolvable liner to expose the adhesive in case of the dissolvable liner label or for otherwise activating the dissolvable liner in case of the dissolvable adhesive liner label).

In embodiments, the sprayer 116 may spray the fluid onto the label 20, e.g., on the underside thereof, before the label 20 is adhered to the surface or substrate 10. Alternately or in addition, the sprayer 116 may be used to spray fluid onto the substrate 10 itself before the label 20 is brought in contact therewith. The fluid dispensing means 116 may, in embodiments, include a pump, a spray nozzle, valves, delivery tubes, etc., to allow for the fluid to be dispersed as desired (e.g., onto the underside of the printed label 20 as the printed label 20 travels from the holding tray 114 and comes adjacent the sprayer 116, onto the substrate 10 prior to the application of the label 20 thereto, etc.). The artisan will understand from the disclosure herein that liners other than the dissolvable liners may also, in embodiments, be employed with the label 20. Alternately, the label 20 may employ no liner (i.e., the label 20 may have an exposed adhesive layer) and the holding tray 114 may include a non-stick or other adhesion-resistant coating to preclude undue interaction between the exposed adhesive layer and the holding tray 114.

Figure 3:
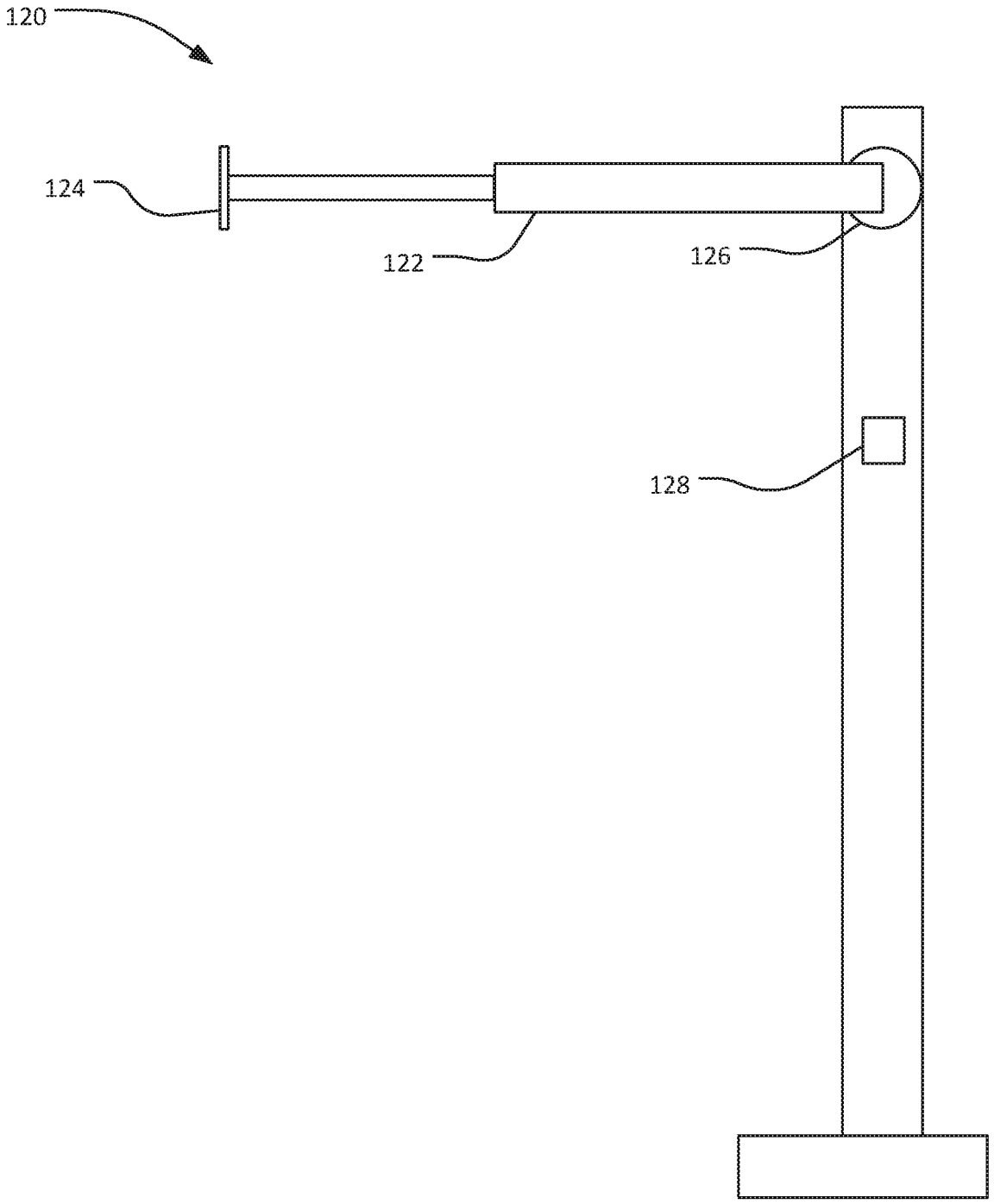
FIG. 3 is a side view of an automated arm of the label printing and applying system of FIG. 1.

The arm 120, as seen in FIG. 3, may comprise a plunger 122, a plate 124, a rotation device 126, and one or more sensors 128. The plunger 122 may be configured to be telescoping (or may otherwise be configured to selectively retract, extend, and/or otherwise adjust position), and may have a plate 124 attached to a distal end thereof. The plate 124 may be configured to hold the tamp head 130 (see FIG. 1), and may, in embodiments, comprise vacuum nozzles to charge the tamp head 130 with a vacuum. The rotation device 126 may be operably coupled to a proximal end of the plunger 122 and may be configured to cause the arm 120 to rotate (or otherwise move) such that the tamp head 130 pulls the printed label 20 from the tray 114 and eventually brings the label 20 in proximity with the substrate 10 for adhesion of the label 20 thereto. In embodiments, before the label 20 is applied to the substrate, the arm 120 may cause the label 20 to be brought proximate the sprayer 116 so that the sprayer may spray fluid on an underside of the label 20 to activate the dissolvable liner or the dissolvable adhesive liner. In other embodiments, the sprayer 116 may directly moisten the substrate 10 before the label 20 is brought into contact therewith by the arm 120. In such cases, the liner may activate when the liner is brought into contact with the wetted substrate 10.

One or more sensors 128 (e.g., LiDAR, infrared, etc.) may be used to detect the presence of the substrate 10, and aid in the process of applying a label 20 to the surface 10. That is, the arm 120 may move the tamp head 130 to the tray 114 for collection of a label 20, and then, using the sensors 128, move the tamp head 130 together with the label 20 to cause the tamp head 130 to adhere the label 20 to the substrate 10. Importantly, printing of the next label 20 may advantageously begin as soon as the tamp head 130 removes the preceding label 20 from the tray 114, resulting in valuable time savings. That is, and as will become clear from the disclosure herein, the waiting time requirement of prior art label applicators may be eliminated or otherwise mitigated.

Figure 4:
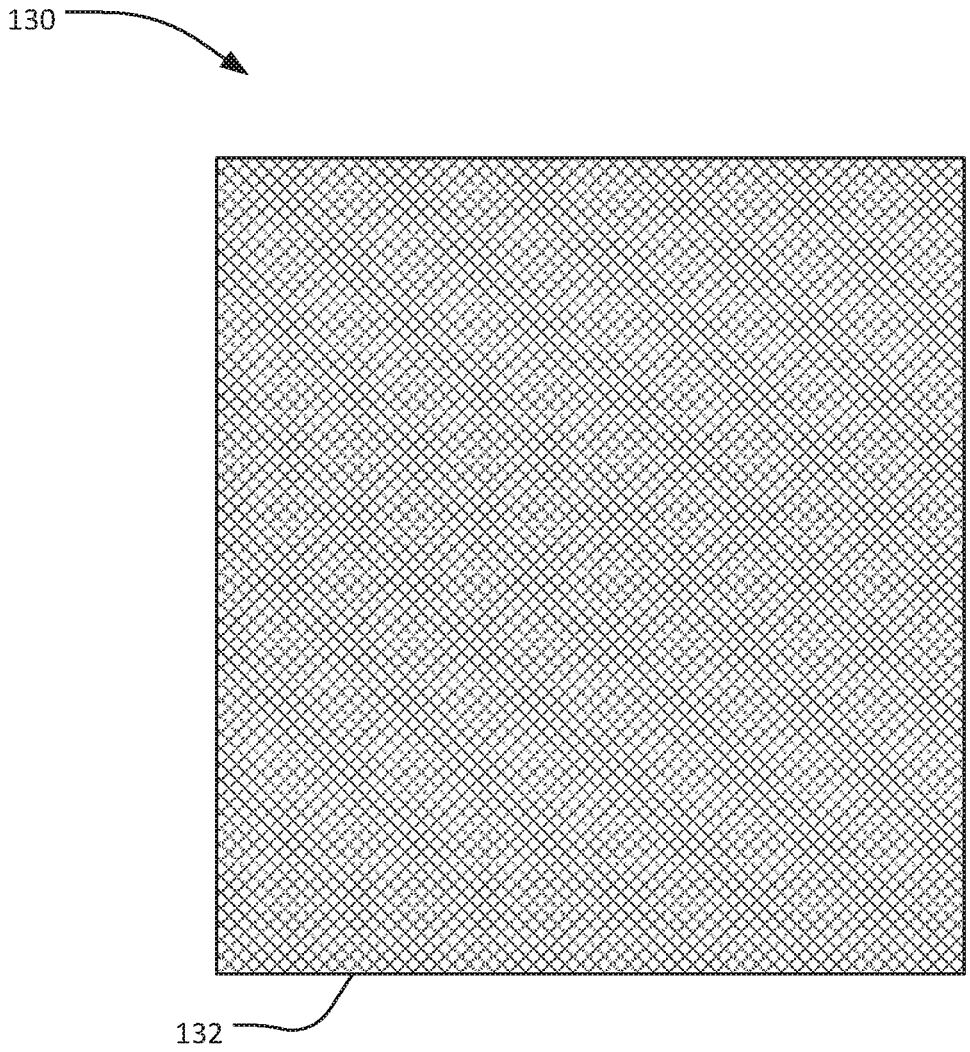
FIG. 4 is a close-up bottom view of a tamp head of the label applicator system of FIG. 1.

The tamp head 130, as seen in FIG. 4, may in embodiments comprise filter media 132 made of a compressible material which may be charged with a vacuum. For example, the filter media 132 may comprise a foam block about two inches thick, which easily allows air to pass through the block. The filter media 132 may be attached to the arm 120 via the plate 124. In operation, the vacuum charged filter media 132 may be used for the collection of a label 20 from the holding tray 114 and for the subsequent application of the label 20 to the substrate 10.

In embodiments, multiple apparatuses 100 may be provided, e.g., in line, to allow for various labels and associated documents to be printed and applied to the substrate 10 as the substrate 10 travels to the various apparatuses 100 on a conveyer belt. For instance, in embodiments, one labeling apparatus 100 may be used to print and apply to the substrate 10 the label 20, another downstream label applicator 100 may be used to print and apply to the substrate 10 a packing list (which may, e.g., be secured above the label 20), yet another downstream apparatus 100 may be used to adhere a coupon above the packing list, etc.

Figure 5:
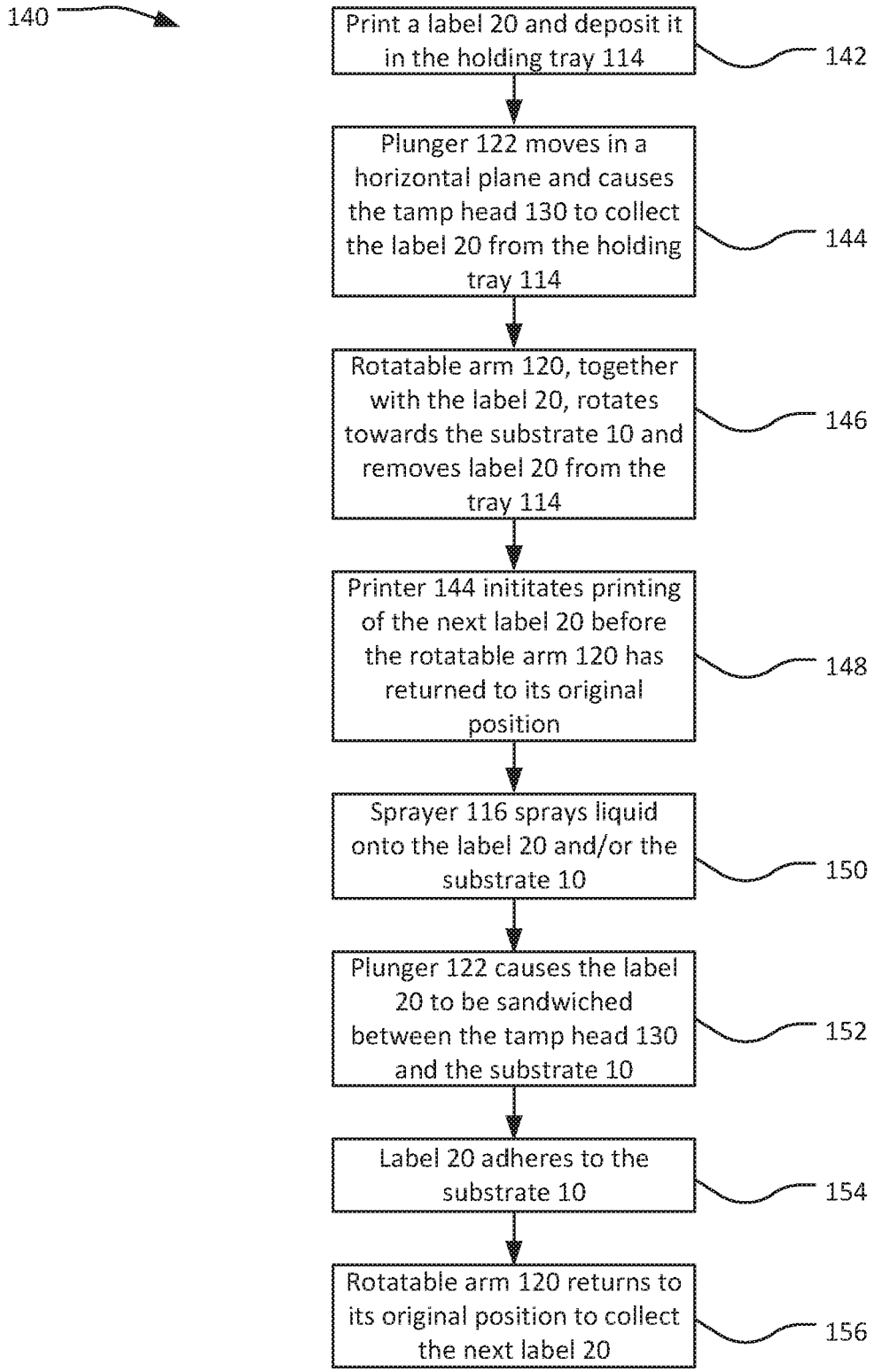
FIG. 5 is a flow chart illustrating a method for operating the label printing and applying system of FIG. 1, in an embodiment.

FIG. 5 is a flowchart depicting a method 140 of printing labels and applying these labels to substrates, in an example embodiment. First, at step 142, a label 20 may be printed using the printer 112 and deposited within the holding tray 114. For example, as discussed above, the label 20 may be held within the holding tray 114 using a laterally extending edge 114A, a vacuum, etc.

Figure 7:
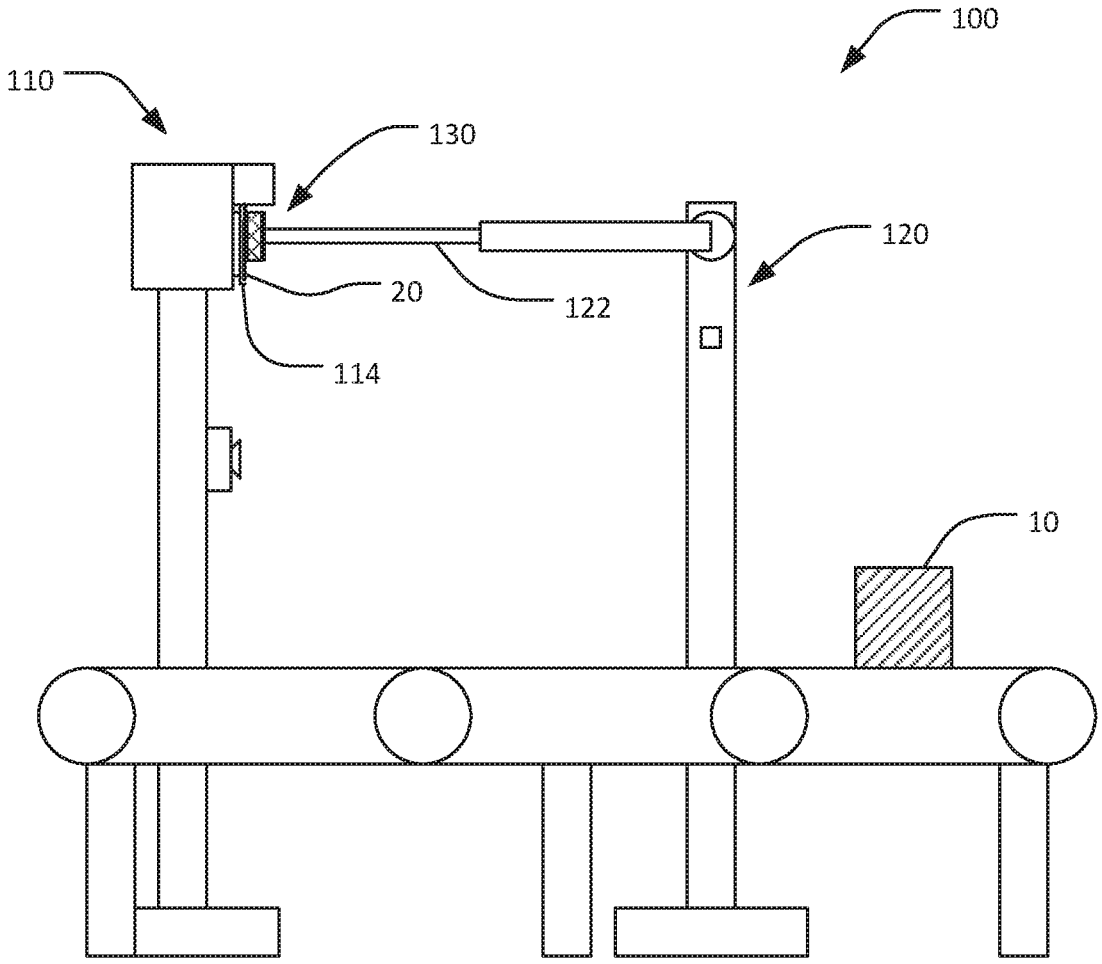
FIGS. 7-10 illustrate example operation of the label printing and applying system of FIG. 1, in an embodiment.

FIG. 1 shows the automated arm 120 in its initial or original position. At step 144, once the label 20 is printed and held in the holding tray 114 as shown in FIGS. 1-2, the automated arm 120 and/or a portion thereof may extend (e.g., horizontally) to an intermediate position. For example, the telescoping plunger 122 may telescope and/or otherwise extend in the horizontal plane to a first position such that the tamp head 130 contacts the label 20 being held in the holding tray 114 (see FIG. 7) for collection. Alternately, the plunger 122 may be brought proximate the label 20 in the holding tray 114 so that the label 20 adheres to the tamp head 130 by virtue of a vacuum.

At step 146, once the tamp head 130 has collected the label 20 from the holding tray 114, the rotatable arm 120 may rotate (towards the substrate 10 to another intermediate position) while the label 20 is secured to the tamp head 130 (e.g., via a vacuum), and resultantly, remove the label 20 from the tray 114. At step 148, as soon as the label 20 is removed from the tray 114, printing of the next label 20 by the printer 112 may be initiated.

Figure 8:
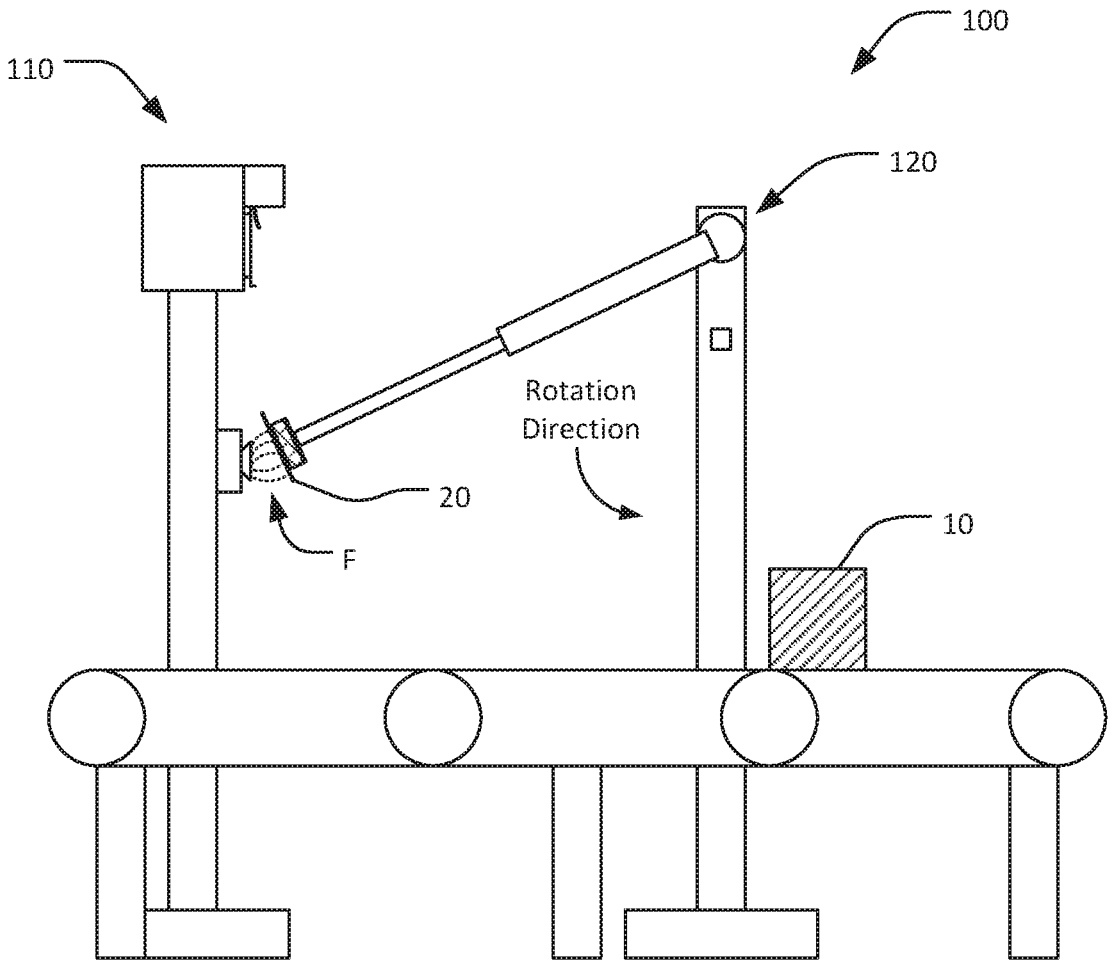
Figure 8A:
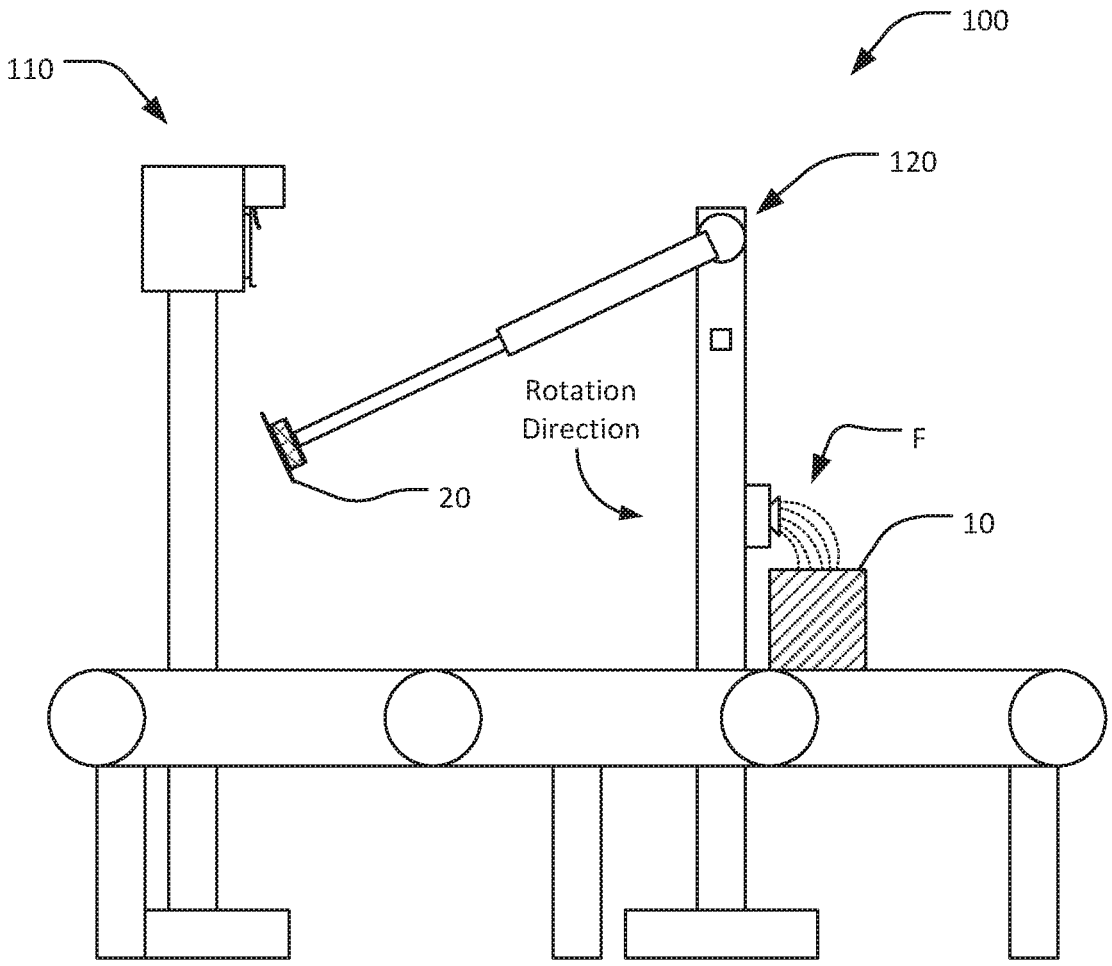
FIG. 8A illustrate example operation of another label printing and applying system, in an embodiment.

At step 150, fluid may be sprayed onto the label 20 and/or on the substrate 10 (which substrate 10 may be moving on the conveyer belt) by the sprayer 116 to allow for the dissolvable liner or dissolvable adhesive liner at the underside of the label 20 to be activated. For example, the rotatable arm 120 may continue to rotate towards the substrate 10 while the label 20 is adhered to the tamp head 130 and resultantly bring the label 20 proximate the sprayer 116 (see FIG. 8A) in another intermediate position. The sprayer 116 may spray fluid F (e.g., water) on the label 20 to dispel the dissolvable liner or dissolvable adhesive liner thereon. Alternately or additionally, the sprayer 116 may spray the fluid F onto the substrate 10 itself so that the moistened substrate 10 may dispel the dissolvable liner on the label 20 when the label is brought in contact therewith, as shown in FIG. 8A.

Figure 9:
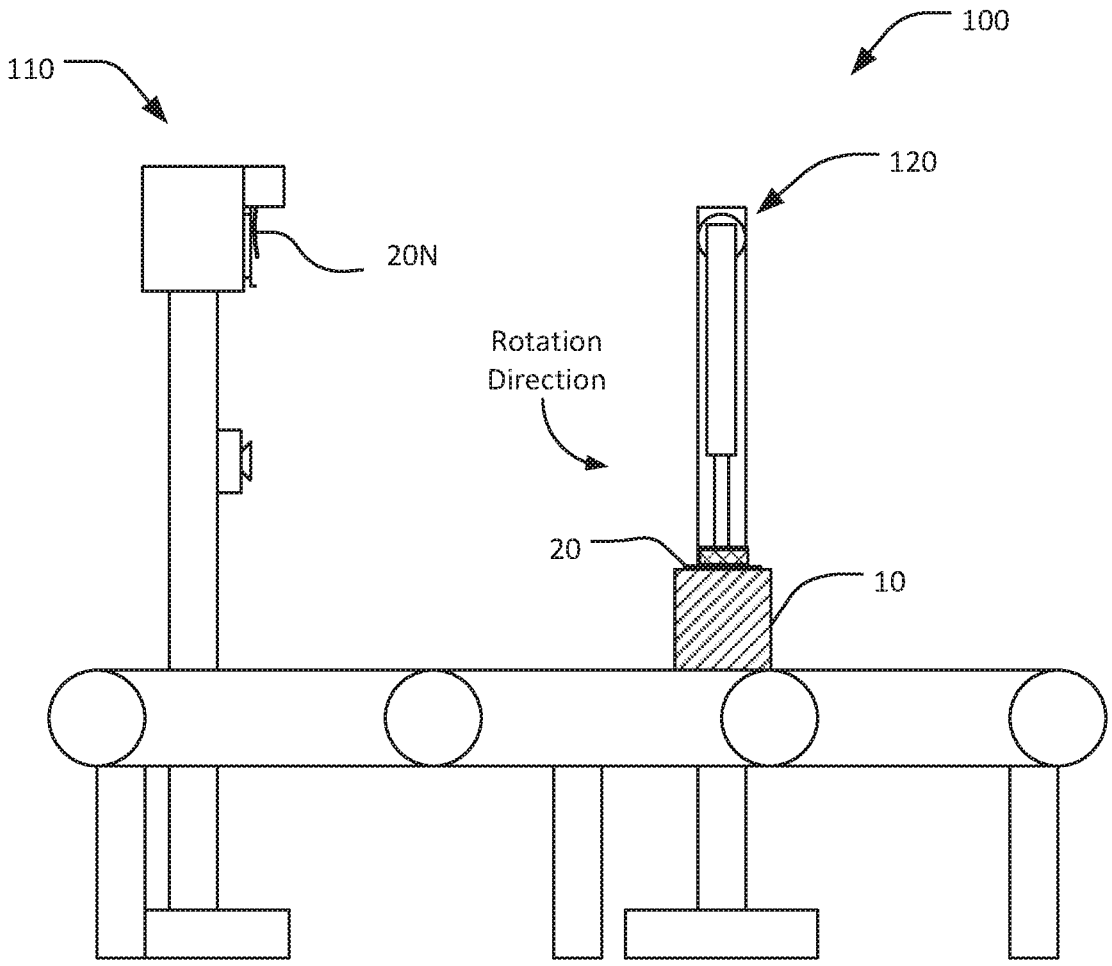

At step 152, the rotatable arm 120 may continue to rotate towards the substrate 10, and eventually, the movable plunger 122 may cause the tamp head 130 to sandwich the label 20 between the substrate 10 and the tamp head 130 (see FIG. 9). This position of the arm 120 may be referred to as the second position. When the underside of the label 20 contacts the substrate 10, the moisture on the underside of the label 20 and/or on the substrate 10 may cause the dissolvable liner coating disposed on the label 20 to dissolve into the substrate 10 to adhere thereto (e.g., by nature of the label 20 exposed adhesive, by nature of the label 20 dissolvable liner infiltrating the substrate 10 and drying therein, et cetera).

Figure 10:
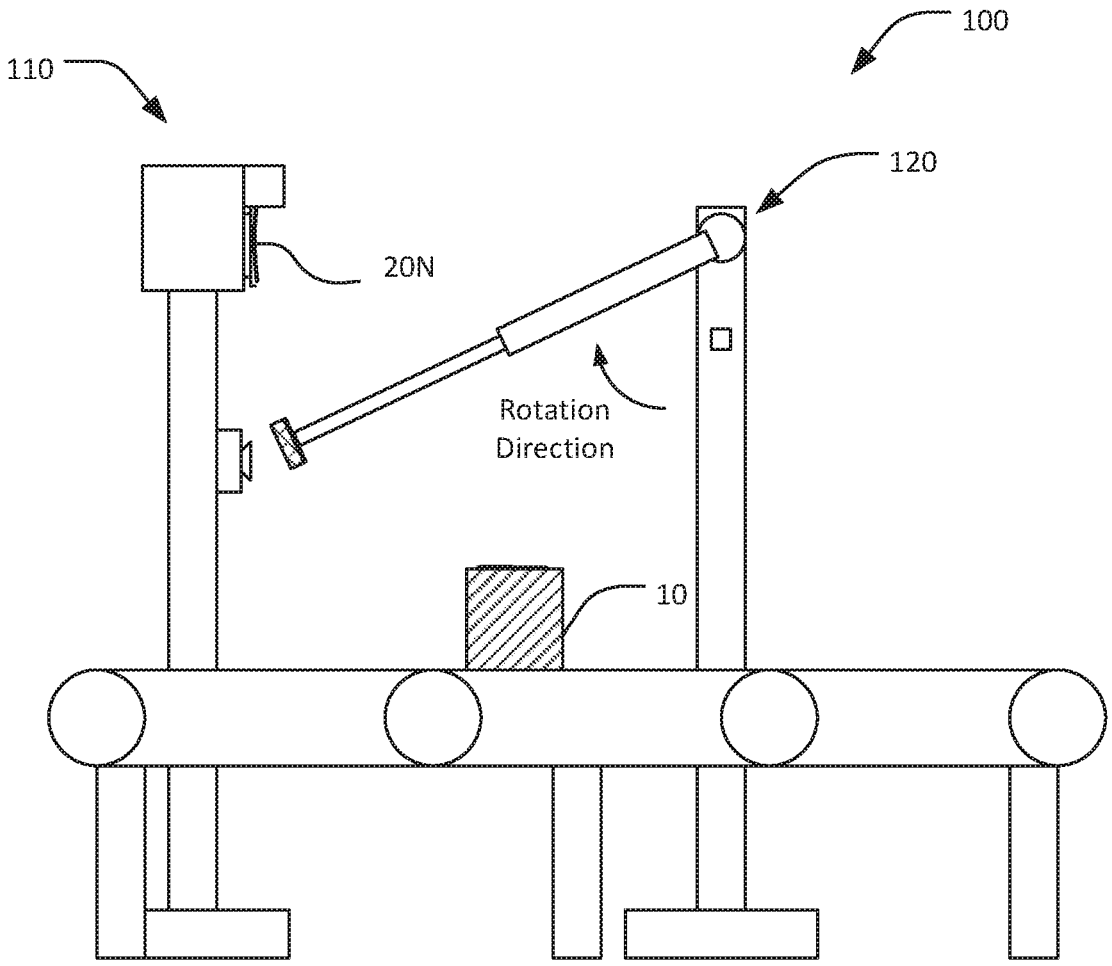

At step 156, once the label 20 is adhered, the rotatable arm 120 may return to its original position (see FIG. 10 showing the arm 120 returning to its original position). By this time, the printer 112 may already have printed the next label 20N in its entirety and deposited same into the tray 114 (see FIG. 10). Alternately, the printer 112 may have printed at least part of the next label 20. The rotatable arm 120 may therefore collect the next label 20 from the tray 114, and apply the next label 20 to the next substrate 10 as discussed above. In this way, the waiting time requirement may be eliminated or at least greatly reduced, allowing for a greater number of labels to be printed and applied to substrates in a given time period compared to the prior art, yielding significant cost savings.

It is to be understood that the steps of the method 140 need not be carried out in the exact order as described, that some steps may occur simultaneously with other steps, and that some steps may be optional, and that each of these combinations of carrying out the method 140 are within the scope of the present disclosure. For example, spraying of the fluid F by the sprayer 116 at step 150 may be unnecessary where a traditional paper liner is being used as opposed to a dissolvable liner.

Figure 11:
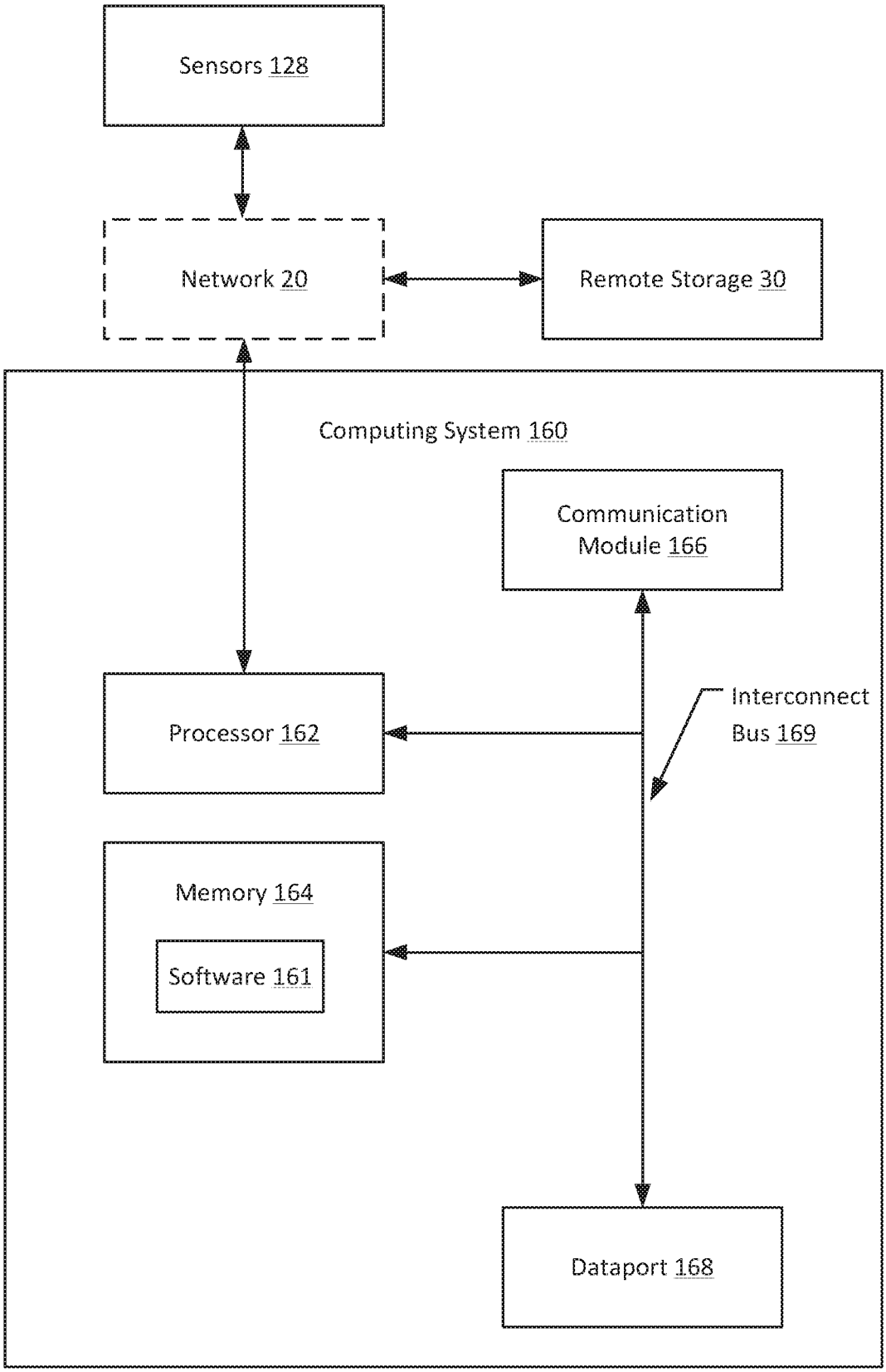
FIG. 11 is a block diagram illustrating a computing system of the label printing and applying system of FIG. 1.

FIG. 11 is a functional block diagram of the computing system 160 which may be used to implement the various labeling apparatus embodiments according to the different aspects of the present disclosure. The computing system 160 may be, for example, a smartphone, a laptop computer, a desktop computer, a flexible circuit board, or other computing device whether now known or subsequently developed. The computing system 160 comprises a processor 162, the memory 164, a communication module 166, and a dataport 168. These components may be communicatively coupled together by an interconnect bus 169. The processor 162 may include any processor used in smartphones and/or other computing devices, including an analog processor (e.g., a Nano carbon-based processor). In certain embodiments, the processor 162 may include one or more other processors, such as one or more microprocessors, and/or one or more supplementary co-processors, such as math co-processors.

The memory 164 may include both operating memory, such as random access memory (RAM), as well as data storage, such as read-only memory (ROM), hard drives, optical, flash memory, or any other suitable memory/storage element. The memory 164 may include removable memory elements, such as a CompactFlash card, a MultiMediaCard (MMC), and/or a Secure Digital (SD) card. In certain embodiments, the memory 164 includes a combination of magnetic, optical, and/or semiconductor memory, and may include, for example, RAM, ROM, flash drive, and/or a hard disk or drive. The processor 162 and the memory 164 each may be located entirely within a single device, or may be connected to each other by a communication medium, such as a USB port, a serial port cable, a coaxial cable, an Ethernet-type cable, a telephone line, a radio frequency transceiver, or other similar wireless or wired medium or combination of the foregoing. For example, the processor 162 may be connected to the memory 164 via the dataport 168.

The communication module 166 may be configured to handle communication links between the computing system 160 and other external devices or receivers, and to route incoming/outgoing data appropriately. For example, inbound data from the dataport 168 may be routed through the communication module 166 before being directed to the processor 162, and outbound data from the processor 162 may be routed through the communication module 166 before being directed to the dataport 168. The communication module 166 may include one or more transceiver modules configured for transmitting and receiving data, and using, for example, one or more protocols and/or technologies, such as GSM, UMTS (3GSM), IS-95 (CDMA one), IS-2000 (CDMA 2000), LTE, FDMA, TDMA, W-CDMA, CDMA, OFDMA, Wi-Fi, WiMAX, 5G, or any other protocol and/or technology.

The dataport 168 may be any type of connector used for physically interfacing with a smartphone, computer, and/or other devices, such as a mini-USB port or an IPHONE®/IPOD® 30-pin connector or LIGHTNING® connector. In other embodiments, the dataport 168 may include multiple communication channels for simultaneous communication with, for example, other processors, servers, and/or client terminals.

The memory 164 may store instructions for communicating with other systems, such as a computer. The memory 164 may store, for example, a program (e.g., computer program code) adapted to direct the processor 162 in accordance with the embodiments described herein. The instructions also may include program elements, such as an operating system. While execution of sequences of instructions in the program causes the processor 162 to perform the process steps described herein, hard-wired circuitry may be used in place of, or in combination with, software/firmware instructions for implementation of the processes of the present embodiments. Thus, unless expressly noted, the present embodiments are not limited to any specific combination of hardware and software.

In embodiments, the memory 164 includes software 161. The software 161 may contain machine-readable instructions configured to be executed by the processor 162. The software 161 may, for example, process data obtained from the sensor 128. In embodiments, the software 161 may cause the computing system 160 to dynamically respond to a reading obtained by the sensor 128. For example, the software 161 may direct the automated arm 120 to collect a label 20 in response to a sensor 128 determination that the label 20 has been deposited in the holding tray 114. As another example, the software 161 may direct the automated arm 120 to bring the label 20 into contact with the substrate 10 in response to a sensor 128 determination that the substrate 10 is ready to receive the label 20 (i.e., the substrate 10 is within reach of the automate arm 120).

The computing system 160 may be in data communication with a remote storage 30 over a network 20. The network 20 may be a wired network, a wireless network, or comprise elements of both. In embodiments, the network 20 may communicatively link one or more components of the labeling apparatus 100. For example, the sensor 128 may be communicatively linked to the computing system 160 via the network 20 for the exchange of information therebetween. The remote storage 30 may be, for example, the "cloud" or other remote storage in communication with other computing systems. In embodiments, data (e.g., readings obtained by the sensor 128 and the dynamic responses of the computing system 160 thereto) may be stored in the remote storage 30 for analytics.

Various types of labels having one or more of many different types of suitable adhesives may be printed and applied using the labeling apparatus 100. One example of a type of label that may be used with the labeling apparatus 100 is a conventional liner label, which comprises a face ply, an adhesive layer, and a liner ply. The face ply may have a top side where indicia (e.g., information, icons, text, etc.) may be printed, and a bottom side where the adhesive layer (e.g., hot-melt, acrylic based, rubber based, pressure sensitive, drying, etc.) is applied. The adhesive used include permanent adhesive (i.e., relatively difficult to remove and/or may damage the surface adhered to), removable adhesive (i.e., relatively easy to peel off), repositionable (i.e., relatively easy to remove and reapply for a short period of time before becoming permanent), remoistenable adhesive (i.e., adhesive that may be activated by moisture), etc. The liner ply may contain a release agent (e.g., silicone) on one or both sides, for removably coupling the liner ply to the bottom side of the face ply. In operation, the liner ply may be used to prevent the adhesive along the conventional liner label from adhering to undesirable surfaces. The liner ply may be removed to expose the adhesive prior to adhering the label to the substrate. In some embodiments, the label may forgo the use of a liner ply, and instead use specially crafted equipment (e.g., an adhesion-resistant printer 112 and/or holding tray 114) that may reduce or eliminate occurrences of the exposed adhesive sticking to undesirable surfaces.

Another example of a type of label 20 that may be used with the automatic label applicator system 100 is a dissolvable liner label comprising one or more face plies, an adhesive layer, and a dissolvable liner. The face ply may have a top face, where indicia may be located (e.g., information, icons, text, etc.) and a bottom face where the adhesive layer may be located. The adhesive layer may be made up of one or more adhesives (e.g., hot melt, acrylic based, rubber based, pressure sensitive, etc.), which may cover some or all of the bottom face. In some embodiments, the adhesive layer may have a pattern of coverage (e.g., cross-hatch, spaced dots, stripes, etc.) on the bottom face, and an additional hydrophilic layer (e.g., an ink jet coating) may be added between the adhesive layer and the bottom face. In operation, and depending on the configuration of the substrate 10 and/or the face ply, the adhesive-and-hydrophilic-coating pattern of coverage may allow the label 20 to more desirably adhere to a surface 10.

The dissolvable liner may cover the adhesive layer, and may disintegrate upon contact with water. In operation, the dissolvable liner may prevent the adhesive layer from adhering to an undesirable surface. Alternately, the dissolvable liner may exhibit adhesive properties once activated using a fluid. To apply the label with the dissolvable liner or the dissolvable adhesive liner, a fluid may first be applied to a desired surface 10. For example, water may be sprayed, misted, or wiped upon a desired surface 10 (and/or to the label). Second, the dissolvable liner label may be applied to the wetted surface 10, with the dissolvable liner making direct contact with the water. The water may then break down the dissolvable liner, exposing the adhesive layer to the surface 10 for adherence therebetween. In embodiments, the dissolvable liner may be wetted before application to a desired surface 10. While water is used in the present disclosure as an example, it is to be understood that any suitable fluid may be used to activate the dissolvable liner or the dissolvable adhesive liner.

In some embodiments, the labels 20 may comprise marketing materials. The marketing materials may comprise one or more tabs portraying indicia. The tabs may be attached to and/or formed as part of the conventional liner label, the dissolvable liner label, or both. In some embodiments, the tabs may be removably attached to the labels by perforations, allowing for the tabs to be torn off. The indicia may comprise information for a consumer, such as coupons, advertisements, promotions, etc. For example, the marketing materials may be several tabs with "20% OFF NEXT PURCHASE" printed on each of them, and the tabs may be torn away from their labels 20 for use. In some embodiments, the marketing materials may be a separately applied label 20 of a type described previously (e.g., a dissolvable liner label or a conventional liner label).

Figure 6:
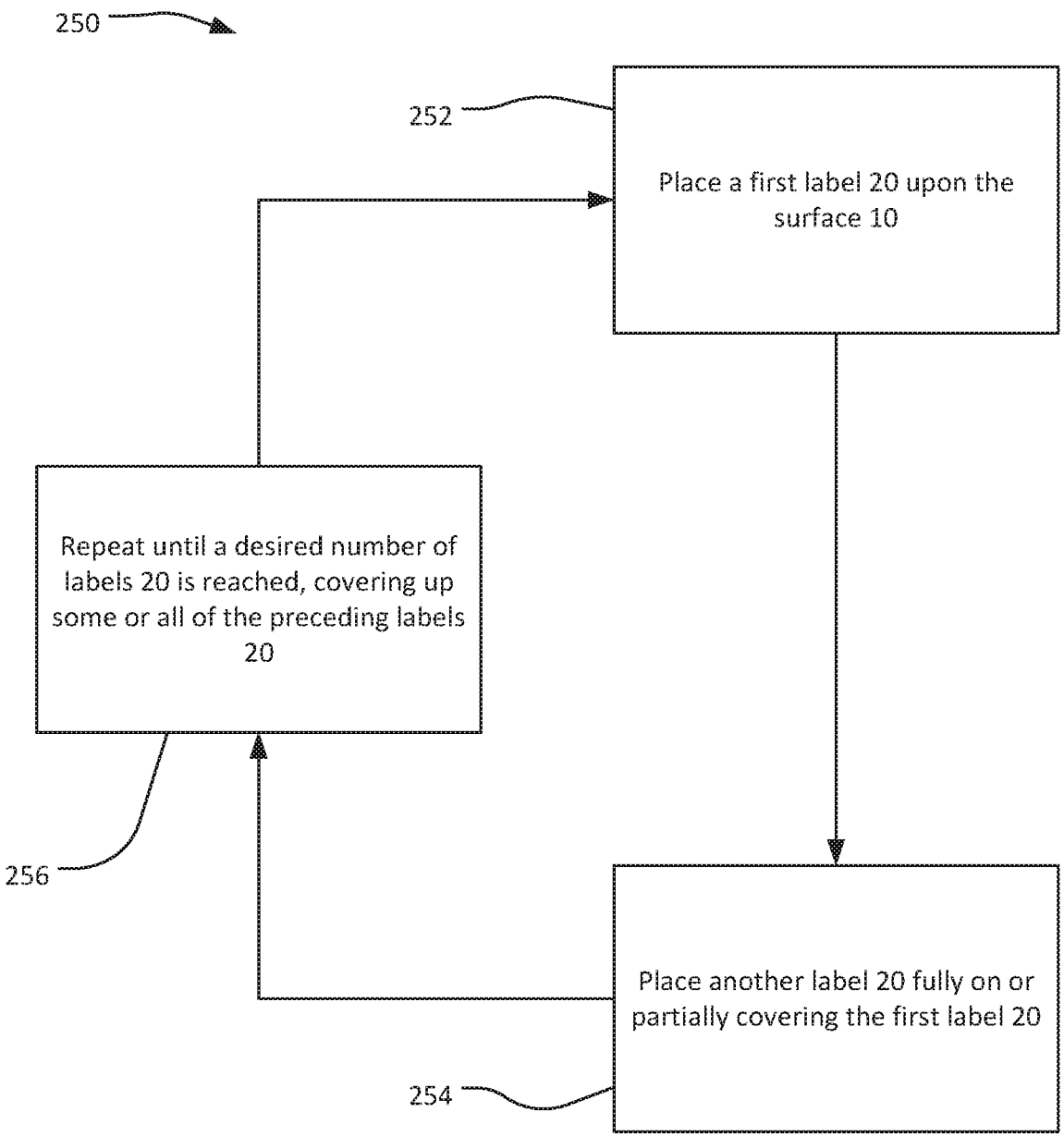
FIG. 6 is a flow chart illustrating a method for stacking labels applied using a plurality of label printing and applying systems of FIG. 1.

A flowchart depicting a method 250 for stacking labels 20 on a substrate 10 is shown in FIG. 6. The process begins at step 252, where a first label 20 (i.e., a dissolvable liner label or a conventional liner label) is applied to a surface 10. For example, the liner ply may be removed from the face ply of the conventional liner label to expose the adhesive along the bottom side for application to the surface 10, or the surface 10 may be wetted and the dissolvable liner label may be placed in contact with the surface 10 for adhesion therebetween. Marketing materials may be incorporated into the labels 20 as described above. At step 254, a second label 20 (e.g., a dissolvable liner label, a conventional liner label, another label type) may be applied. The second label 20 may be applied over the surface 10, the first label 20, or at least some of both. For example, the second label 20 may be placed in such a manner so as to cover the entire first label 20, except for the tabs of marketing materials of the first label 20. In embodiments where the second label 20 is a dissolvable liner label, both the surface 10 and the first label 20 may be wetted in preparation for application of the dissolvable liner label. In some embodiments, the dissolvable liner labels may be wetted instead of or in addition to the surface 10 and/or the other labels. The second label may be a packing list, a coupon, or any other substrate containing indicia.

At step 256, steps 252 and 254 may be repeated until there are a desired number of labels 20 stacked on the package 10. Each additional label 20 may cover some or all of the preceding label 20. It is to be understood that the number of labels 20 that can be stacked is not limited in the scope of the present disclosure.

Figure 12:
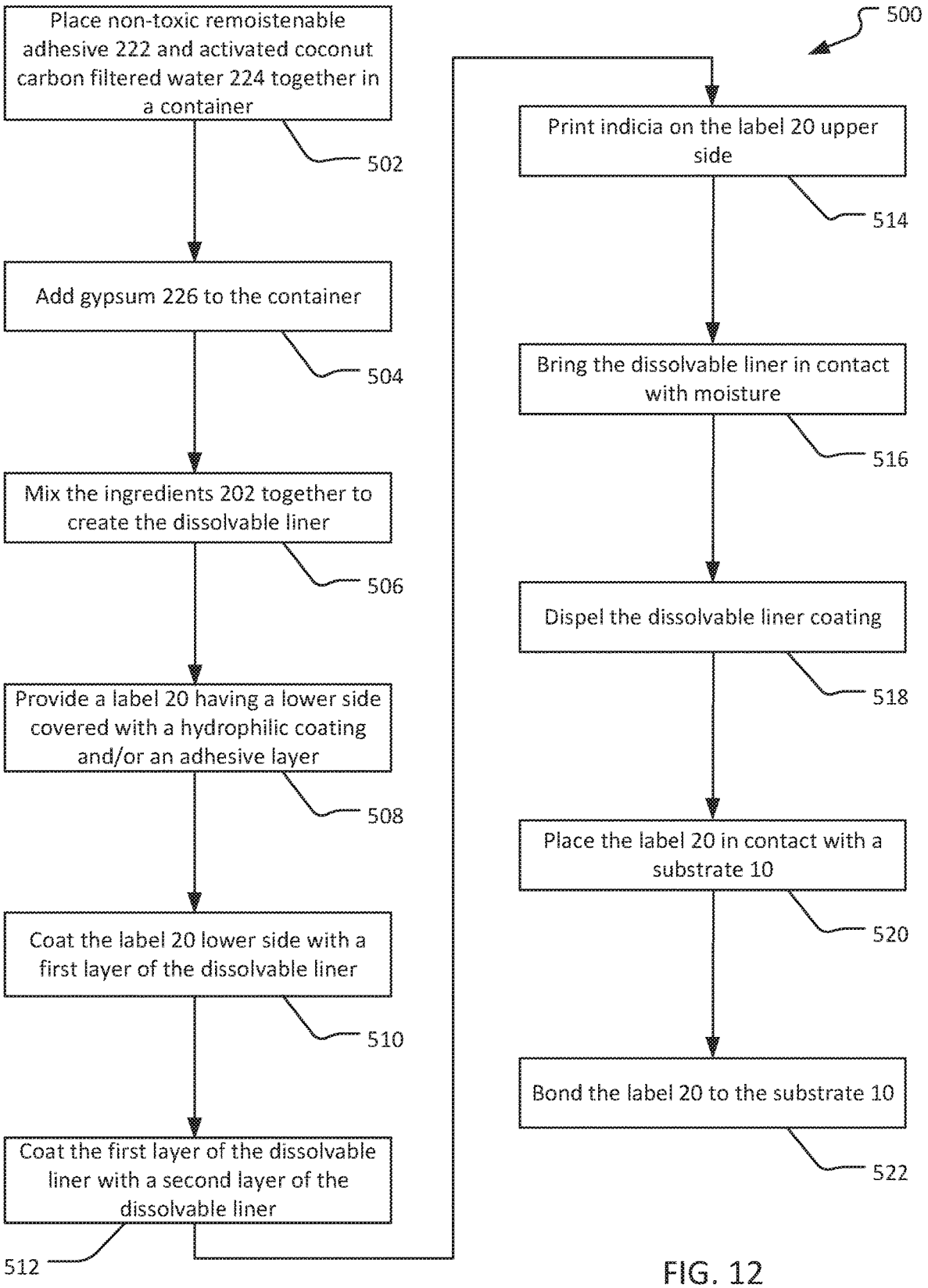
FIG. 12 is a flowchart illustrating a method for making and using labels with a dissolvable liner for using with the label printing and applying system of FIG. 1.

FIG. 12 is a flow chart illustrating a method 500 of making and using the label 20 (e.g., a dissolvable liner label, a dissolvable adhesive liner label, etc.), in an embodiment. At step 502, a non-toxic remoistenable adhesive 222 may be placed in a container together with activated coconut carbon filtered water 224. For example, 4 lbs. of PB121-H-Prisco® may be weighed and placed in a container together with 0.25 lbs. of activated coconut carbon filtered water. Thereafter, at step 504, about 1.2 lbs. (i.e., about 21 heaping teaspoons) of gypsum 226 may be placed in the container. The quantities of the various ingredients may be proportionally different or different. At step 506, the ingredients 202 may be mixed together. For example, in an embodiment, a cutting blade spinning at about 2,000 rpm may be used to mix all the ingredients 202 until the resulting mixture becomes relatively smooth and homogenous. At step 508, the back side of a label 20 may be covered (e.g., by an adhesive layer and/or a hydrophilic coating). At step 510, the label 20 lower side may be coated with a first layer of the dissolvable liner (i.e., the first layer may be applied to the label 20 such that the hydrophilic coating and/or adhesive layer is between the label 20 face stock and the first dissolvable liner layer). Once the dissolvable liner first layer is dried (e.g., by a dryer), then, at step 512, a second layer of dissolvable liner may be applied and dried. Additional layers of the dissolvable liner may also be provided.

In embodiments, only a solitary layer of the dissolvable liner may be employed to cover the hydrophilic coating and/or adhesive layer. In other embodiments, and particularly when employing the dissolvable adhesive liner label (as opposed to the dissolvable liner label), two (or more) layers of the dissolvable liner may be successively dried and applied. Applicant's experiments have shown that the multiple combined dissolvable liner layers may be more suitable for certain applications.

While the method 500 illustrates an embodiment of the label 20 using two layers of dissolvable liner, it is to be understood that more layers of dissolvable liner may be used. For example, a preferable range of dissolvable liner layers may be two to four layers, though the label 20 can be configured to include more layers of dissolvable liner. Including more than four layers of dissolvable liner may require a greater amount of hydrophilic coating, which may increase the cost of the label 20. Each layer of the dissolvable liner may be relatively thin (e.g., 0.1 to 0.2 mm thick). Conversely, if traditional remoistenable adhesive were to be used, one would have to use 10-15 times more adhesive for the same application, which may, in addition to having other drawbacks, may be cost prohibitive.

At step 514, indicia may be printed (e.g., via the printer 112) on the upper side of the label 20. The label 20 may be printed using any suitable printer type (including any conventional printer, such as a direct thermal printer, a thermal transfer printer, a laser printer, et cetera). Specifically, as the label 20 is passed through the printer, the top face thereof may receive printed indicia whereas the dissolvable liner may cover the label 20 lower side and preclude the label 20 from adhering to printer parts. When the label 20 is ready to be adhered to a substrate, the dissolvable liner coating may be brought into contact with water or another fluid (e.g., via the sprayer 116) at step 516 to cause the dissolvable liner coating to dispel. The activated dissolvable liner may then be made ready to reveal the adhesive layer, or permeate the label 20, the hydrophilic layer, and/or the substrate 10.

Moisture (used herein interchangeably with "water" or "fluid") may be introduced to the dissolvable liner directly and/or indirectly. In an embodiment, the substrate 10 (e.g., the box, package, envelope, etc.) and/or a section thereof may be moistened with water and the dissolvable liner may be placed on the moistened section of the substrate 10 so as to allow the dissolvable liner coating to interact with the moisture on the substrate 10 (indirect moistening) and dissolve (e.g., dissolve into the substrate 10 and the hydrophilic coating). In another embodiment, instead of moistening the substrate 10 and then placing the dissolvable liner on the moistened substrate 10, the dissolvable liner coating itself may be moistened to cause the dissolvable liner coating to dispel (direct moistening) and then the label 20 may be situated on the substrate 10. For example, if the moisture is applied directly to the dissolvable liner coating, the label 20 may then be adhered to the substrate 10 any time within the next 90 seconds or so. Alternately, if the substrate 10 is moistened instead of directly moistening the dissolvable liner coating, then the label 20 may have to be placed on the moistened section of the substrate 10 within 3-20 seconds or so (as the moisture may thereafter be absorbed by the substrate 10 and may not be able to serve to activate the dissolvable liner coating). In some embodiments, moisture may be introduced to the dissolvable liner coating both directly and indirectly (i.e., the substrate 10 may be moistened and the dissolvable liner coating may also be moistened before the contact is made with the moistened substrate 10).

At step 518, the moisture introduced to the dissolvable liner coating (e.g., directly and/or indirectly) may cause the dissolvable liner coating to dispel. At step 520, if the moisture was introduced to the dissolvable liner directly, the label 20 may now be situated on the substrate 10, and the substrate 10 may absorb (e.g., partially) the dissolvable liner coating. Conversely, if the moisture was introduced to the dissolvable liner indirectly (e.g., a section of the substrate 10 was moistened and the dissolvable liner was placed in contact with the moistened section of the substrate 10), the moisture on the substrate 10 may cause the dissolvable liner coating to dispel and the liner coating may be absorbed (e.g., partially) by the substrate 10.

At step 522, the label 20 may bond to the substrate 10 (e.g., by virtue of the now-drying activated dissolvable liner which has infiltrated the substrate 10 and the hydrophilic layer, the exposed adhesive layer, et cetera). In this way, by needing water to activate the dissolvable liner, the dissolvable liner may remain in the inert state until the label 20 is to be applied to the substrate 10. Furthermore, the requirement for a traditional liner ply may be negated, as well as, in some embodiments, the requirement for a traditional adhesive layer. The amount of water used to dissolve the liner coating may be negligible (e.g., relative to traditional remoistenable adhesives) and may not cause any appreciable damage to the substrate 10. Once the dissolvable liner is wetted (directly and/or indirectly) and the label 20 is situated on the substrate 10, the dissolvable adhesive liner may dissolve relatively quickly such that the label 20 can generally simultaneously be adhered to the substrate 10. That is, dissolving of the dissolvable liner coating into the substrate 10 in step 518 and adherence of the label 20 to the substrate 10 in step 520 may occur generally at the same time.

It is to be understood that the steps of the method 500 may be modified, added to, and/or omitted as desired, and that such considerations have been contemplated and are within the scope of the present disclosure. For example, the artisan may understand that the method 500 may be readily modified to apply a single layer of dissolvable liner to the label 20.

Thus, as has been described, the dissolvable liner may, in effect, replace both traditional liner plies and the adhesive layers of prior art labels, and labels 20 employing a dissolvable liner may be used in any application where prior art labels were heretofore employed.

As noted, one advantage of the labeling system 100 may be that it may allow a printer to continuously print labels while the tamp head is moving between the printer and a desired surface for label application. Conversely, printers on existing label applicator systems may only be able to print off the next label for application once the tamp head has returned to the printer. Because the next label in an automatic label applicator system 100 may be ready and waiting for pick up by the tamp head as soon as the tamp head completes its cycle, there may be a significant reduction in the time it takes to apply a large number (e.g., thousands) of labels, relative to existing label application systems.

While example labels (e.g., shipping labels), are used to illustrate the workings of the system 100, the artisan will understand that the automatic label applicator system 100 disclosed herein may be adapted to other similar label application functions, and that such adaptions are within the scope of the present disclosure. Examples of other similar label application functions may include pharmaceutical packaging, food and beverage packaging, parts labeling, etc.

The artisan will understand that the labeling system 100 disclosed herein may include or have associated therewith electronics (e.g., the computing system 160, the sensors 128, etc.). The electronics may be used to control and modify the operation of the labeling system (e.g., to change the timing of the system 100, to turn the system 100 on and off, to dynamically control the system 100 in response to a sensor 128 detection, et cetera). In some example embodiments, the processor or processors may be configured through particularly configured hardware, such as an application specific integrated circuit (ASIC), field-programmable gate array (FPGA), etc., and/or through execution of software to allow the labeling system 100 to function in accordance with the disclosure herein.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

What is claimed is:

1. A method for printing and applying labels, comprising:
covering an adhesive layer of a first label with a dissolvable liner, said dissolvable liner comprising each of a remoistenable adhesive, activated coconut carbon filtered water, and gypsum;
printing indicia on said first label using a printer to form a first printed label;
holding said first printed label in a holding tray;
moving an arm from an original position to a first position to collect said first printed label from said holding tray;
rotating said arm in a first direction to move said first printed label towards a substrate;
moistening said first printed label to activate said dissolvable liner of said first printed label;
using said arm to apply said moistened first printed label to said substrate; and
rotating said arm in a second direction away from said substrate;
wherein, said printer has printed a second label before said arm returns to said original position to collect said second label from said holding tray; and
said first printed label is moistened indirectly.

2. The method of claim 1, further comprising using a sprayer for the moistening of said first printed label.

3. The method of claim 2, wherein said holding tray extends vertically.

4. The method of claim 3, wherein said holding tray comprises a lip.

5. The method of claim 1, wherein said arm includes a tamp head.

6. The method of claim 1, wherein said arm is configured to be telescoping.

7. The method of claim 1, further comprising applying said second label to said substrate such that said second label overlaps said first printed label on said substrate.

8. The method of claim 7, wherein said first label is a packing slip and said second label is a shipping label.

9. A method for printing and applying labels, comprising:
covering an adhesive layer of a first label with a dissolvable liner, said dissolvable liner comprising each of a remoistenable adhesive, activated coconut carbon filtered water, and gypsum;
printing indicia on said first label using a printer to form a first printed label;
holding said first printed label in a vertical holding tray;
moving an arm from an original position to a first position to collect said first printed label from said holding tray;
rotating said arm in a first direction to move said first printed label towards a substrate;
moistening said first printed label after said first printed label has been collected by said arm to activate said dissolvable liner of said first printed label;
using said arm to apply said moistened first printed label to said substrate; and
rotating said arm in a second direction away from said substrate.

10. The method of claim 9, further comprising using a computing system to control a timing of said arm.

11. The method of claim 9, wherein said holding tray comprises a lip.

12. The method of claim 9, wherein said arm includes a tamp head.

13. The method of claim 9, wherein said first label comprises a hydrophilic layer.

14. The method of claim 9, further comprising applying said second label to said substrate such that said second label overlaps said first printed label on said substrate.

15. The method of claim 14, wherein said first label is a packing slip and said second label is a shipping label.

16. The method of claim 9, wherein said first printed label is moistened indirectly.

17. A method for printing and applying labels, comprising:

covering an adhesive layer of a first label with a dissolvable liner, said dissolvable liner comprising each of a remoistenable adhesive, activated coconut carbon filtered water, and gypsum;

printing indicia on said first label using a printer to form a first printed label;

holding said first printed label in a vertical holding tray with a vacuum charge;

moving an arm from an original position to a first position to collect said first printed label from said holding tray;

rotating said arm in a first direction to move said first printed label towards a substrate;

using said arm to apply said first printed label to said substrate; and rotating said arm in a second direction away from said substrate;

wherein, said printer has printed a second label before said arm returns to said original position to collect said second label from said holding tray.

18. The method of claim 17, further comprising using a second arm downstream of said first arm to stack a plurality of labels on said substrate.

* * * * *